US009938074B2

(12) United States Patent
Dogan et al.

(10) Patent No.: US 9,938,074 B2
(45) **Date of Patent: *Apr. 10, 2018**

(54) INGREDIENT CAPSULE FOR BEVERAGE PREPARATION

(71) Applicant: NESTEC S.A., Vevey (CH)

(72) Inventors: Nihan Dogan, La Croix-sur-Lutry (CH); Nicolas Jean-Guy Bezet, Macon (FR)

(73) Assignee: Nestec S.A., Vevey (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/399,668

(22) PCT Filed: May 1, 2013

(86) PCT No.: PCT/EP2013/059069
§ 371 (c)(1),
(2) Date: Nov. 7, 2014

(87) PCT Pub. No.: WO2013/167437
PCT Pub. Date: Nov. 14, 2013

(65) Prior Publication Data

US 2015/0072053 A1 Mar. 12, 2015

(30) Foreign Application Priority Data

May 7, 2012 (EP) ..... 12166967

(51) Int. Cl.
*B65D 85/804* (2006.01)

(52) U.S. Cl.
CPC ..... *B65D 85/8043* (2013.01)

(58) Field of Classification Search
CPC ..... B65D 85/8043; A47J 31/44; A47J 31/54; A47J 31/0657; A47J 31/24; A47G 19/14
(Continued)

(56) References Cited

U.S. PATENT DOCUMENTS 5,261,459 A * 11/1993 Atkinson ..... A61M 39/24 137/846
8,147,887 B2 4/2012 Dogan et al.
(Continued)

FOREIGN PATENT DOCUMENTS

CN 101641265 2/2010
DE 202006013189 10/2006
(Continued)

OTHER PUBLICATIONS

Office Action issued in related Chinese Patent Application No. 201380024296.4 dated Nov. 23, 2016.

*Primary Examiner* — Michele L Jacobson
*Assistant Examiner* — Ericson M Lachica
(74) *Attorney, Agent, or Firm* — K&L Gates LLP

(57) ABSTRACT

Capsule (9) for use in a beverage preparation machine (1), said capsule comprising side (10), bottom (12) and top (11) walls defining a closed chamber, said chamber containing an ingredient to be dissolved and/or extracted by a fluid injected under pressure within said capsule, said fluid being provided through an injection element (20) of the machine that is able to pierce an injection wall of the chamber, said capsule further comprising a beverage dispensing wall able to open for releasing a beverage prepared from said ingredient and said fluid, said capsule comprising a separating wall (14) within the chamber that separates, in a leak-tight manner:—an ingredient-containing compartment (15), and—a fluid injection compartment (16), said separating wall (14) comprising a one-way valve (17) able to let fluid under pressure flow only from the injection compartment (16) towards the ingredient-containing compartment (15).

4 Claims, 5 Drawing Sheets

(58) Field of Classification Search
USPC ..... 426/77, 78, 79, 80, 81, 82, 83, 84; 99/295
See application file for complete search history.

(56) References Cited

U.S. PATENT DOCUMENTS

| | | | | |
|---|---|---|---|---|
| 9,745,122 | B2 * | 8/2017 | Dogan | B65D 85/8043 |
| 2002/0015768 | A1 * | 2/2002 | Masek et al. | 426/115 |
| 2006/0280841 | A1 * | 12/2006 | Cai | 426/77 |
| 2007/0186784 | A1 * | 8/2007 | Liverani | A47J 31/0668 99/295 |
| 2010/0043646 | A1 * | 2/2010 | Suggi Liverani et al. | 99/295 |
| 2010/0129512 | A1 * | 5/2010 | Accursi | 426/431 |
| 2010/0180775 | A1 * | 7/2010 | Kollep et al. | 99/295 |
| 2012/0070542 | A1 * | 3/2012 | Camera | B65D 85/8043 426/77 |
| 2015/0125576 | A1 * | 5/2015 | Dogan | 426/115 |

FOREIGN PATENT DOCUMENTS

| | | |
|---|---|---|
| EP | 1579792 | 9/2005 |
| WO | 0056629 | 9/2000 |
| WO | 2008132571 | 11/2008 |

* cited by examiner

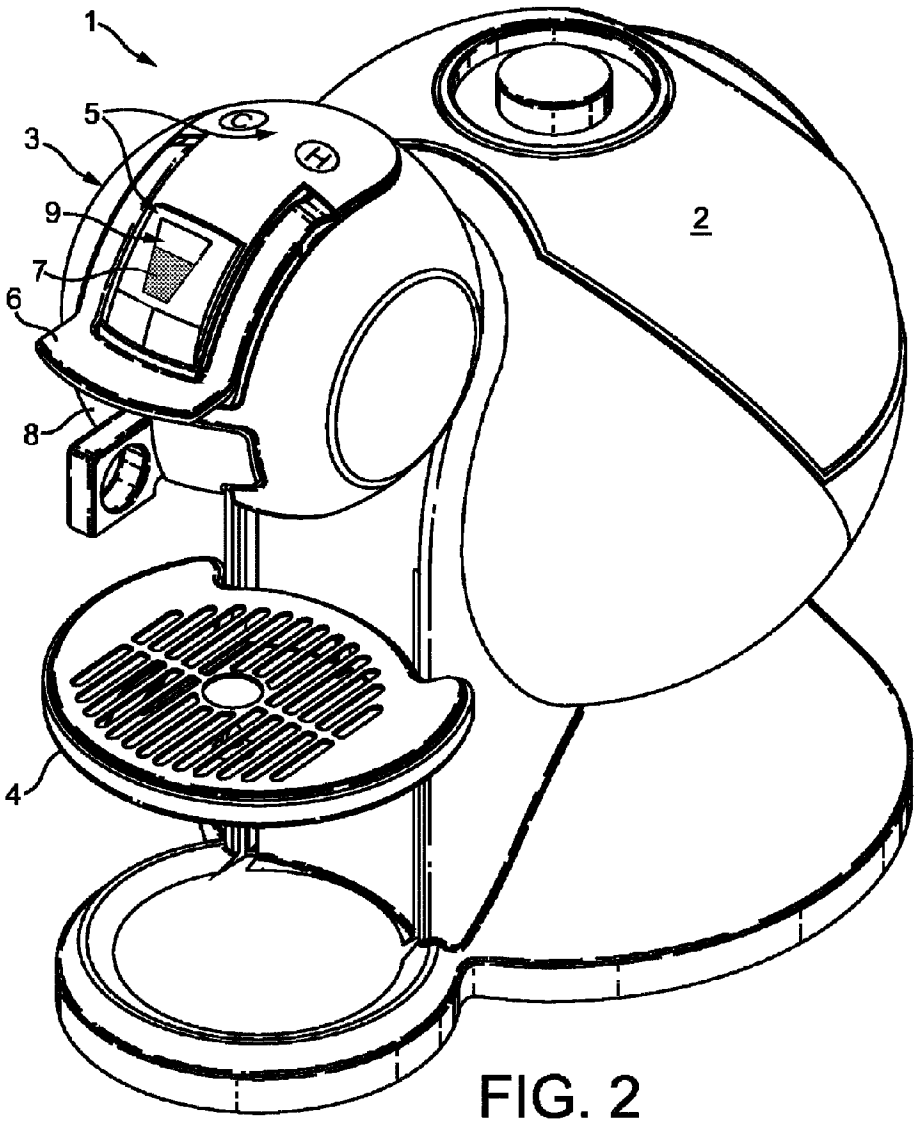
FIG. 2
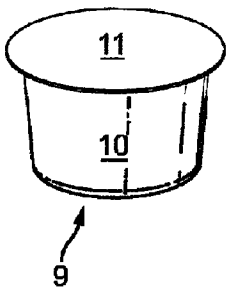

INGREDIENT CAPSULE FOR BEVERAGE PREPARATION

CROSS REFERENCE TO RELATED APPLICATIONS

The present application is a National Stage of International Application No. PCT/EP2013/059069, filed on May 1, 2013, which claims priority to European Patent Application No. 12166967.5, filed May 7, 2012, the entire contents of which are being incorporated herein by reference.

FIELD OF THE INVENTION

The present invention concerns a capsule for use in a beverage preparation machine; more precisely it concerns a capsule having an anti-backflow feature.

BACKGROUND OF THE INVENTION

Beverage preparation machines are well known in the food science and consumer goods area. Such machines allow a consumer to prepare at home a given type of beverage, for instance a coffee-based beverage, e.g. an espresso or a brew-like coffee cup.

Today, most beverage preparation machines for in-home beverage preparation comprise a system made of a machine which can accommodate portioned ingredients for the preparation of the beverage. Such portions can be soft pods or pads, or sachets, but more and more systems use semi-rigid or rigid portions such as rigid pods or capsules. In the following, it will be considered that the beverage machine of the invention is a beverage preparation machine working with a rigid or semi-rigid capsule.

The machine comprises a receptacle for accommodating said capsule and a fluid injection system for injecting a fluid, preferably water, under pressure into said capsule. Water injected under pressure in the capsule, for the preparation of a coffee beverage according to the present invention, is preferably hot, that is to say at a temperature above 70° C. However, in some particular instances, it might also be at ambient temperature. The pressure inside the capsule chamber during extraction and/or dissolution of the capsule contents is typically about 1 to about 8 bar for dissolution products and about 2 to about 12 bar for extraction of roast and ground coffee. Such a preparation process differs a lot from the so-called "brewing" process of beverage preparation—particularly for tea and coffee, in that brewing involves a long time of infusion of the ingredient by a fluid (e.g. hot water), whereas the beverage preparation process allows a consumer to prepare a beverage, for instance coffee, within a few seconds.

The principle of extracting and/or dissolving the contents of a closed capsule under pressure is known and consists typically of confining the capsule in a receptacle of a machine, injecting a quantity of pressurized water into the capsule, generally after piercing a face of the capsule with a piercing injection element such as a fluid injection needle mounted on the machine, so as to create a pressurized environment inside the capsule either to extract the substance or dissolve it, and then release the extracted substance or the dissolved substance through the capsule. Capsules allowing the application of this principle have already been described for example in applicant's European patent no EP 1 472 156 B1, and in EP 1 784 344 B1.

Machines allowing the application of this principle have already been described for example in patents CH 605 293 and EP 242 556. According to these documents, the machine comprises a receptacle for the capsule and a perforation and injection element made in the form of a hollow needle comprising in its distal region one or more liquid injection orifices. The needle has a dual function in that it opens the top portion of the capsule on the one hand, and that it forms the water inlet channel into the capsule on the other hand.

The machine further comprises a fluid tank—in most cases this fluid is water—for storing the fluid that is used to dissolve and/or infuse and/or extract under pressure the ingredient(s) contained in the capsule. The machine comprises a heating element such as a boiler or a heat exchanger, which is able to warm up the water used therein to working temperatures (classically temperatures up to 80-90° C.). Finally, the machine comprises a pump element for circulating the water from the tank to the capsule, optionally though the heating element. The way the water circulates within the machine is e.g. selected via a selecting valve means, such as for instance a peristaltic valve of the type described in applicant's European patent application EP 2162653 A1.

When the beverage to be prepared is coffee, one interesting way to prepare the coffee is to provide the consumer with a capsule containing roast and ground coffee powder, which is to be extracted with hot water injected therein.

Capsules have been developed for such an application, which are described and claimed in applicant's European patent EP 1 784 344 B1, or in European patent application EP 2 062 831.

In short, such capsules comprise typically:

- a hollow body and an injection wall which is impermeable to liquids and to air and which is attached to the body and adapted to be punctured by e.g. an injection needle of the machine,
- a chamber containing a bed of roast and ground coffee to be extracted,
- an aluminum membrane disposed at the bottom end of the capsule, closing the capsule, for retaining the internal pressure in the chamber, the membrane being associated with piercing means for piercing dispensing holes in the aluminum membrane when the internal pressure inside the chamber reaches a certain pre-determined value,
- optionally, means configured to break the jet of fluid so as to reduce the speed of the jet of fluid injected into the capsule and distribute the fluid across the bed of substance at a reduced speed.

Capsules of the prior art feature an injection wall or membrane (referred to as top membrane) which is to be pierced by a fluid injection element (e.g. needle) of a beverage preparation machine being part of a fluid system. When fluid is injected in the capsule compartment, a pressure is built up, which serves as an extraction means for extracting and/or dissolving ingredients contained inside the capsule, as described above. Such ingredients can be for instance a bed of roast and ground coffee "RG" as shown in FIG. 1.

In prior art capsules, when the injection needle is removed from the capsule injection wall, after the beverage has been prepared and dispensed, the capsule top membrane is pierced and a hole "H" remains as illustrated in FIG. 1. However, the internal extraction fluid pressure "P" remains at least partly in the capsule compartment.

The consumer can stop the extraction at any given time and open the machine head, which will create a hole "H" on top membrane while the capsule is still inside the machine.

This results in product coming out of top hole (this phenomenon is referred to as "backflow") and causing machine cleanliness issue. Our tests showed that even 0.05 bar is enough to create product back-flow from the top hole on the capsule, due to capsule being full with water or dilute product depending on when the consumer stops the machine.

In some exceptional cases, the backflow is very important due to a very high residual internal pressure within the capsule so that a jet of liquid splashes out of the capsule, which is named "whale effect". Such a "whale effect" is represented as jet "J" in FIG. 1. Although such a phenomenon occurs randomly and infrequently, it is undesirable because hot liquid splashing out is messy. Moreover, in case the liquid is water mixed with an ingredient, such a leakage of liquid from the capsule top membrane is also undesirable for a cleanliness point of view, which forces the consumer to spend time cleaning the machine and its surroundings after usage.

A solution was developed in current machines to prevent early opening of the machine brewing head, particularly until the capsule internal fluid pressure is sufficiently low. This solution is a five second light blinking on the machine to show consumer not to open the machine head until the blinking stops. However, this solution does not work during extraction of recipes for which more than 5 seconds is necessary to release the pressure inside the capsule after the fluid injection has been stopped inside the capsule.

It is therefore an objective of the present invention to provide a beverage preparation system and capsule that prevents the so-called "backflow" or "whale effect" phenomenon described above, whatever the beverage preparation conditions or ingredient properties.

SUMMARY OF THE INVENTION

The main objective set out above is met with a capsule for use in a beverage preparation machine, said capsule comprising side, bottom and top walls defining a closed chamber, said chamber containing an ingredient to be dissolved and/or extracted by a fluid injected under pressure within said capsule, said fluid being provided through an injection element of the machine that is able to pierce an injection wall of the chamber, said capsule further comprising a beverage dispensing wall able to open for releasing a beverage prepared from said ingredient and said fluid.

Said capsule comprises a separating wall within the chamber that separates, in a leak-tight manner:

- an ingredient-containing compartment, and
- a fluid injection compartment,
- said separating wall comprising a one-way valve able to let fluid under pressure flow only from the injection compartment towards the ingredient-containing compartment.

Of course, at least a portion of said separating wall is located at a distance from the injection wall that is sufficient to ensure that the machine injection element does not pierce through said separating wall into said ingredient-containing compartment.

This invention describes a system in which the fluid (e.g. water) that is injected by the machine through the capsule injection wall, will first fill in the fluid compartment, and the hydraulic pressure in said compartment will open the valve that connects to the ingredient-containing compartment.

The one-way valve can be placed at any point according to where the water jet needs to be created. At the end of extraction when pump is stopped, the hydraulic pressure in the top chamber will go down and the valve will be closed. This in turn will prevent the product reaching the hole on the top membrane. It will also provide air tightness as the top level will be full of water. This air tightness also ensures anti-dripping from the capsule bottom. In any case, even if some liquid leaves the hole pierced through the injection wall of the capsule by the injection element of the machine, this liquid can only be water and not product, which will therefore not be a cleanliness issue.

According to an essential aspect of the invention, the one-way valve is either:

- an umbrella or piston valve that is able to circulate fluid under pressure within the ingredient-containing compartment, to produce a multidirectional divergent spraying in the form of at least one fine layer of water, or
- a duckbill or piston valve that is able to circulate fluid under pressure within the ingredient-containing compartment, in the form of a jet.

In case the one-way valve that is used is a piston valve, the shape of the water flow that is injected into the capsule ingredient-containing compartment, depends on the shape of the flow-conducting channel wherein the piston slides. For instance, if said channel is a straight cylinder, the injected water will generally take the shape of a single jet that can be directed vertically or at an angle relative to the vertical axis of the capsule. In case the flow-conducting channel has for example at least one horizontally-directed outlet with a slot shape, then the injected water will take the form of at least one fine layer of water that is sprayed throughout the ingredient compartment of the capsule.

In a preferred embodiment of the invention, the injection wall is the top wall, and the beverage dispensing wall is the bottom wall.

A jet will be preferred for injection in a capsule that contains a soluble ingredient because the jet creates a swirl inside the chamber, and the dissolution of the ingredient is enhanced. On the other hand, if the capsule contains an ingredient which is not soluble but requires an even distribution of the fluid to conduct a proper beverage preparation, for instance in case the ingredient is roast and ground coffee, then injection of fluid in the form of a fine layer of water will be preferred. In that case, the fine layer of fluid (e.g. water) preferably extends continuously over the periphery of the injection point and sprays/wets the ingredient in a substantially circular manner.

Advantageously, the fluid is injected by the machine within said capsule at a pressure comprised between 0.1 and 20 bar, preferably between 1 and 15 bar, more preferably between 2 and 12 bar. All pressure values are given relative to the atmospheric pressure, which for the sake of simplification is considered to be 1 bar.

In a highly preferred embodiment of the present invention, the fluid injection element of the machine comprises at least one fluid-injection needle.

In any case, the beverage dispensing wall preferably comprises:

- opening means to open said wall when fluid pressure inside said chamber increases above a first predetermined level, and
- reclosing means to close the capsule, after said beverage has been dispensed from said chamber and the fluid pressure within said chamber has decreased below a second predetermined level.

In the field of the invention, the ingredient contained in the capsule can be roast and ground coffee, and/or can be chosen within the list of water-soluble ingredients such as:

coffee, tea, cocoa, milk, soup, fruit juice, vegetable juice, soda mix, or infant nutrition products, in powder, gel, compacted powder, or liquid concentrate form, or a combination thereof.

BRIEF DESCRIPTION OF THE DRAWINGS

Additional features and advantages of the present invention are described in, and will be apparent from, the description of the presently preferred embodiments which are set out below with reference to the drawings in which:

FIG. 2 is a schematic perspective view of a beverage preparation machine suitable for use with a capsule according to the present invention;

DETAILED DESCRIPTION OF THE INVENTION

Figure 1:
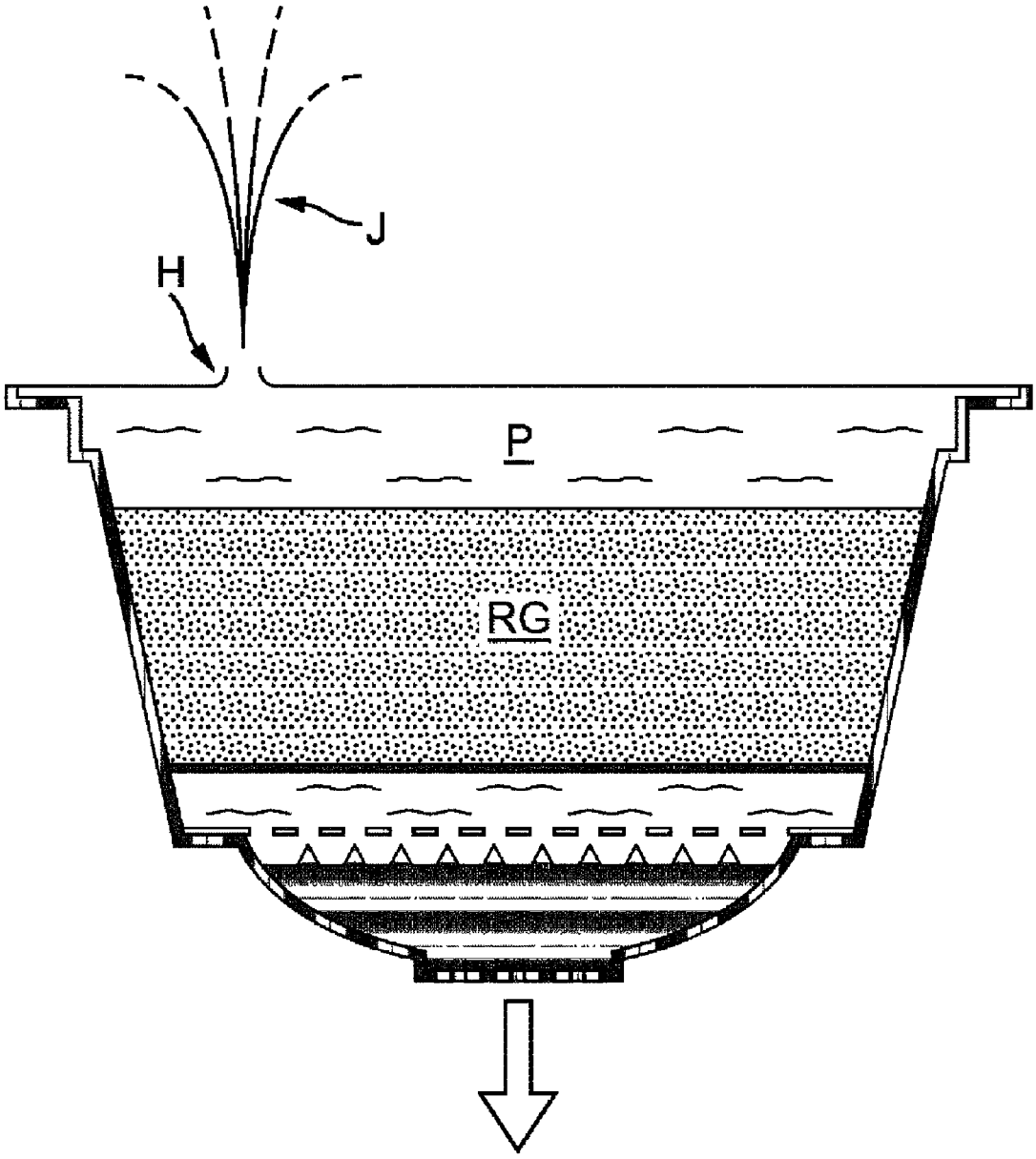
FIG. 1 is a schematic view of a prior art capsule wherein "whale effect" fluid resurgence has occurred.

The capsule according to the present invention is for use in a beverage preparation machine as illustrated in FIG. 2.

Such a beverage preparation machine comprises a base having a reservoir 2, a brewing head 3, a cup tray 4 for holding a cup below the brewing head 3 and wherein the prepared beverage flows. The beverage preparation machine further comprises a control panel 5 for setting working parameters of the machine (e.g. volume of beverage to be dispensed, pressure of the fluid to be injected inside the capsule, temperature of the beverage, etc.).

The beverage preparation machine further comprises a handle 6 for opening and closing the brewing head, respectively in configurations for receiving a capsule and for preparing a beverage (closed brewing head in functional configuration). It also comprises a display 7 for displaying information to the user about the machine settings, progression of the beverage preparation, etc. Also, the machine 1 comprises a capsule holder 8 for holding a capsule 9. Said capsule holder is adapted to be removably introduced in a specific recess of the brewing head 3. In FIG. 2, the capsule holder is shown in place within the brewing head.

A capsule 9 for use in the beverage preparation machine 1 is also illustrated in FIG. 2. It comprises a body with side walls 10, and a top membrane 11. The capsule side walls 10 are rigid or semi-rigid thermoplastic material, and the top membrane 11 is made of a monolayer or multilayer thermoplastic material that is sufficiently thin to be pierceable by a fluid injection needle located in the brewing head of the machine 1.

Figure 3:
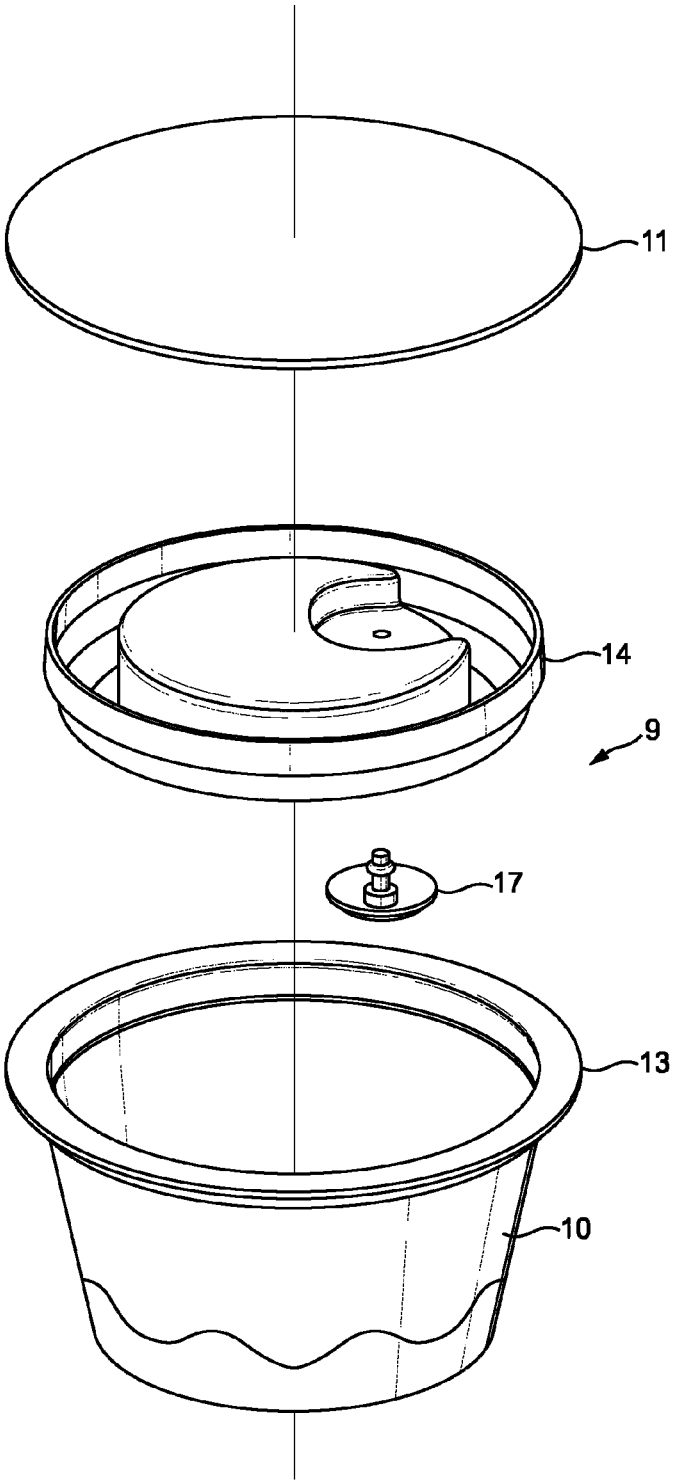
FIG. 3 is a split perspective view of a capsule according to the invention.
Figure 4:
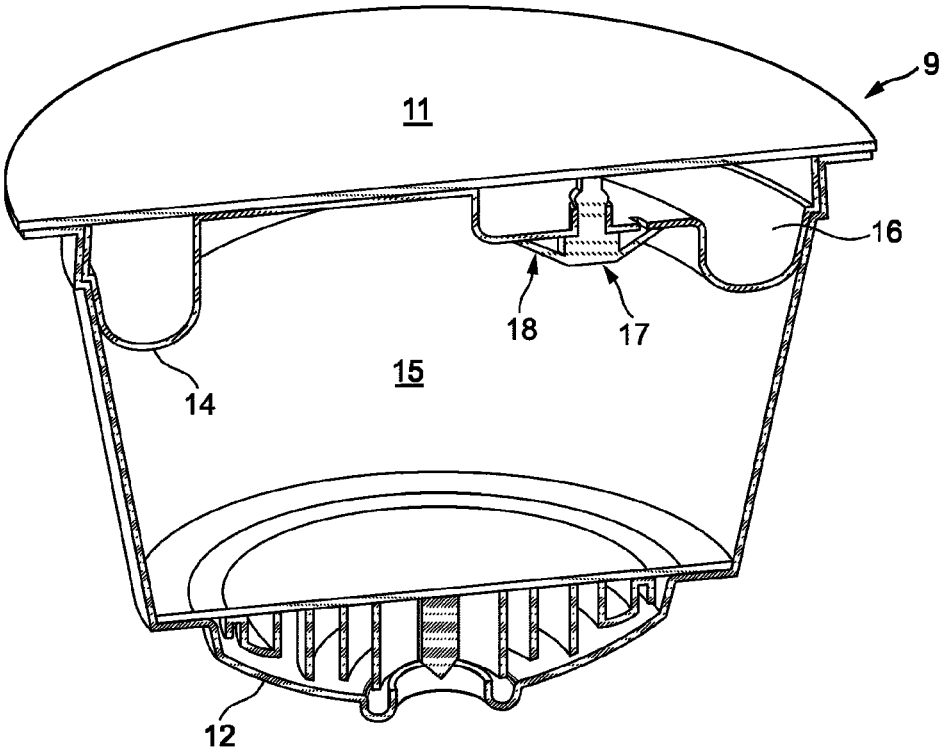
FIG. 4 is a side perspective cut view of a capsule of the invention.

A capsule according to the invention is represented in detail in FIGS. 3 and 4. The capsule bottom wall 12 and side walls 10 are made as one integral part. The capsule further comprises a top membrane 11, which is to be sealed on a top peripheral edge 13 of the capsule side walls 10.

According to the invention, a separating wall 14 is disposed within the capsule internal chamber. The wall 14 separates, in a leak-tight manner:

an ingredient-containing compartment 15, and a fluid injection compartment 16.

The separating wall 14 comprises a one-way valve 17 able to let fluid under pressure flow only from the injection compartment towards the ingredient-containing compartment.

Figure 5:
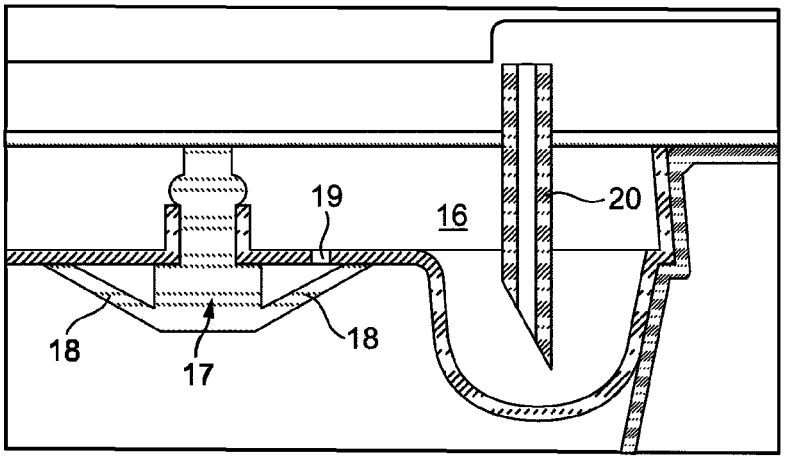
FIG. 5 is an enlarged cut side view showing the arrangement of the fluid injection element of the machine within the fluid-injection compartment of the capsule.
Figure 6A:
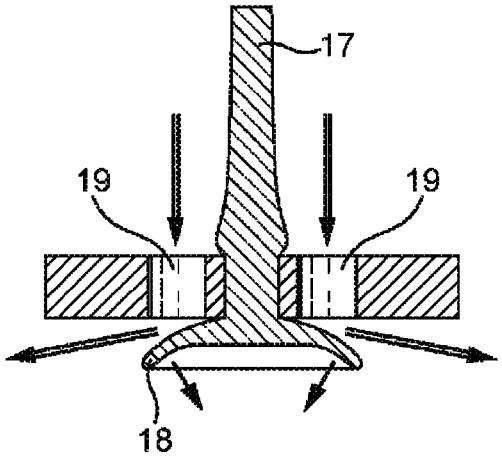
FIGS. 6A and 6B are schematic side views of an umbrella valve in a capsule according to the invention, respectively in its open, and closed configurations.

In the capsule embodiment represented in FIG. 5, the one-way valve 17 is an umbrella valve, which is directed such that the umbrella portion 18 of the valve protrudes within the ingredient-containing compartment. This umbrella portion 18 covers fluid-conducting channels 19. When fluid (e.g. water) is injected from the beverage preparation machine inside the fluid-injection compartment 16, fluid pressure builds-up in the latter. At a certain predetermined pressure level, the umbrella portion 18 of the valve deforms to let fluid under pressure flow from the fluid-injection compartment 16, into the ingredient-containing compartment 15, as illustrated with double arrows in FIG. 6A.

Figure 6B:
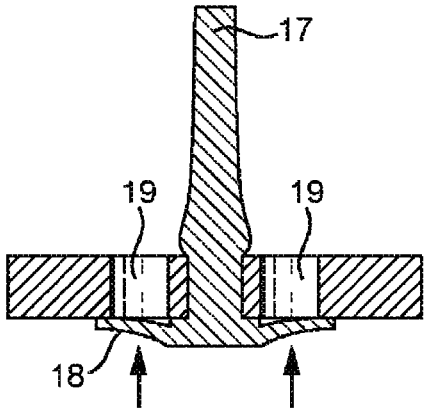

Once the machine fluid pump is stopped, the fluid injection stops and fluid pressure inside the capsule decreases. When said pressure inside the capsule decreases below a certain predetermines level (which corresponds mainly to the mechanical properties of the valve), the umbrella portion 18 flexes back into its original position to close the valve and the circulation of fluid through the channels 19 stops, as illustrated in FIG. 6B.

Figure 7A:
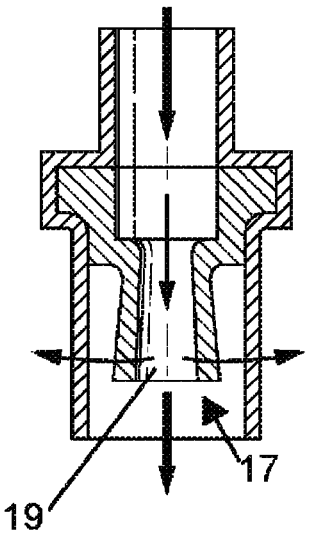
FIGS. 7A and 7B are schematic side views of a duckbill valve in a capsule according to the invention, respectively in its open, and closed configurations.
Figure 7B:
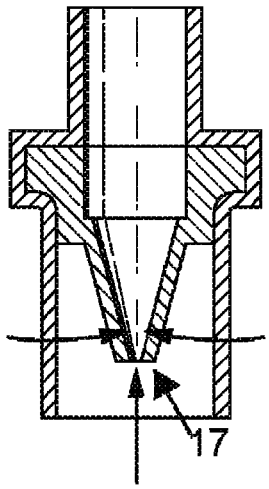

An alternative capsule construction is illustrated in FIGS. 7A and 7B, wherein the umbrella valve and the fluid circulation channels 19 pierced through the separating wall 14 are replaced by a duckbill valve that connects the fluid injection and ingredient-containing compartments.

The fluid circulation principle with the duckbill valve is identical to what was described above for the umbrella valve. The key difference between an umbrella valve and a duckbill valve, is the shape of the fluid flow that is created into the ingredient-containing compartment. In the case of the umbrella valve, the shape of the fluid flow is a flat, substantially disc-shaped spray of fluid, that is evenly distributed across the surface of the ingredient. On the other hand, in the case of a duckbill valve the fluid flows directly through the valve channel as illustrated with double arrows in FIG. 7A, such that the fluid flow inside the ingredient-containing compartment is in the shape of a jet having a high speed, which creates a swirl through the ingredient and therefore improves the mixing effect between the ingredient and the fluid. This last embodiment is particularly useful for preparation of beverages when the ingredient is soluble (either under powder, gel, compacted or liquid form).

In all embodiments, the valve is manufactured out of a flexible deformable material such as for instance a natural or synthetic rubber or silicone.

As illustrated in FIG. 5, the separating wall 14 is sufficiently distant from the top membrane 11 to ensure that the fluid injection needle 20 of the machine does not pierce through said wall 14, and protrudes through the top wall 11 only within the inner space of the fluid-injection compartment 16.

In case the one-way-valve is a piston valve (not illustrated in the drawing), the piston is mounted in a sliding arrangement inside a flow-conducting channel that extends between the injection compartment and the ingredient compartment.

The piston is typically spring-mounted such that:

in its normal, closed position, no fluid can pass through the channel, and the spring is in its extended, rest, configuration, and in its open position, the fluid (water) can pass from the injection compartment towards the ingredient compartment, and the spring is compressed.

The piston valve is actuated by any suitable means, internal or external to the capsule, but most preferably, the piston valve is moved to its open position when the fluid pressure inside the injection compartment increases, such that said pressure pushes onto the piston with a counterforce that increases above the mechanical resistance of the spring. When the beverage machine pump stops, pressure inside the injection compartment of the capsule decreases below the spring force, and the piston valve recloses.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule for use in a beverage preparation machine, the capsule comprising:

side, bottom and top walls defining a closed chamber, the chamber containing an ingredient to be dissolved and/or extracted by a fluid injected under pressure within the capsule, the fluid provided through an injection element of the beverage preparation machine that is able to pierce an injection wall of the chamber;

a beverage dispensing wall able to open for releasing a beverage prepared from the ingredient and the fluid; and a separating wall within the chamber that separates, in a leak-tight manner, an ingredient-containing compartment and a fluid injection compartment, the separating wall comprising (1) a one-way valve able to let the fluid under pressure flow only from the injection compartment towards the ingredient-containing compartment, and (2) an annular recess forming the fluid injection compartment so constructed and arranged to receive the injection element of the beverage preparation machine, wherein the annular recess is arranged radially outwards and in fluid communication with the one-way valve, the one-way valve is a duckbill or piston valve that is able to circulate the fluid under pressure within the ingredient-containing compartment in a form of a jet, and the one-way valve comprising a flexible portion that covers a fluid conducting channel and is configured to deform and open the fluid conducting channel at a predetermined pressure level.

2. The capsule according to claim 1, wherein the fluid injection wall is the top wall, and the beverage dispensing wall is the bottom wall.

3. The capsule according to claim 1, wherein the beverage dispensing wall comprises:

an opening member to open the beverage dispensing wall when a fluid pressure inside the chamber increases above a first predetermined level, and a reclosing member to close the capsule, after the beverage has been dispensed from the chamber and the fluid pressure within the chamber has decreased below a second predetermined level.

4. The capsule according to claim 1, wherein the ingredient is selected from the group consisting of roast and ground coffee, a powder, a gel, a compacted powder, a liquid concentrate form, and combinations thereof.

* * * * *